US006969432B2

(12) United States Patent
Raynaud et al.

(10) Patent No.: US 6,969,432 B2
(45) **Date of Patent: *Nov. 29, 2005**

(54) PRODUCT FOR A WELDED CONSTRUCTION MADE OF ALMGMN ALLOY HAVING IMPROVED MECHANICAL STRENGTH

(75) Inventors: Guy-Michel Raynaud, Voiron (FR); Jean-Luc Hoffmann, Limoges (FR); Laurent Cottignies, Poisat (FR); Georges Pillet, Saint Cassin (FR)

(73) Assignee: Pechiney Rhenalu, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 10/856,793

(22) Filed: Jun. 1, 2004

(65) Prior Publication Data

US 2005/0183795 A1 Aug. 25, 2005

Related U.S. Application Data

(63) Continuation of application No. 10/189,176, filed on Jul. 5, 2002, now abandoned, which is a continuation-in-part of application No. 08/875,113, filed as application No. PCT/FR96/00279 on Feb. 21, 1996, now Pat. No. 6,444,059.

(30) Foreign Application Priority Data

Feb. 24, 1995 (FR) ..... 95 02387
Oct. 9, 1995 (FR) ..... 95 12065

(51) Int. Cl.[7] ..... C22C 21/06
(52) U.S. Cl. ..... 148/440; 148/439; 420/542
(58) Field of Search ..... 148/439, 440; 420/532, 541–553

(56) References Cited

U.S. PATENT DOCUMENTS 5,181,969 A 1/1993 Komatsubara et al.
6,238,495 B1 * 5/2001 Haszler et al. ..... 148/440
6,461,566 B2 * 10/2002 Pfannenmuller et al. .... 420/532

OTHER PUBLICATIONS

Cassie et al, "Composition Affects Tensile Strength of Welded Aluminum-Magnesium Alloy", Metal Construction and British Welding Journal, Jan. 1973, pp. 11-19.*
Scott et al., "Tensile and Toughness Properties of Arc-Welded 5083 and 6082 Aluminum Alloys", Welding Research Supplement, 1983, pp. 243-252.*
Takaai et al "Changes of Microstructure and Some Mechanical Properties Due to Long-Time Temperature Annealing Treatment in 5083 Alloy Sheet", Keikinzoku, vol. 31(4), pp. 219-225 (1982) w/Abstract and English translation (partial).
Mikrostruktur und Mechanische Eigenschaften . . . , Reiners et al, Schweissen und Schneiden 40, 1988, Heft 3, pp. 123-129.
"Relation Between Mechanical Properties and . . . 5083 Alloy Welds", Sugiyama, Sumitomo Keikinzohu Giho (Japan) vol. 19, No. 3-4, pp. 140-151.
Registration Record of International Alloy Designations . . . Wrought Aluminum alloys, The Aluminium Association, Apr. 1991.
"The Deformation of Commercial Aluminum-Magesium Alloys", Lloyd, Metallurgical Transactions A, Vol. 11A, Aug. 1980, pp. 1287-1294.
"Physical Metallurgy of Recycling . . . Alloys", Hess, Metallurgical Transactions A. vol. 14A, Mar. 1983, pp. 323-327.
ASM Specialty Handbook, Aluminum and Aluminum Alloys, ASM International, Materials Pack, 1994, p. 675-676.
"Fracture Toughness . . . Aluminum Alloy Plate", Nelson et al, 1972 Proc.-Nat. Sym. on Fract. Mechs., Phila., Pa 28-30, 1972, ASTM 1973, pp. 350-376.
"Fracture Mechanics Aspects . . . Vessels for LNG Tankers", Kaufman et al, Journal of Eng. Materials and Tech., 1980, vol. 102, pp. 303-314.
"Fatigue of Materials", Suresh, Cambridge Univ. Press, 1991, ISSN 0 521 36510 4, pp. 119-122.
"Microstructure and Toughness . . . Aluminum Alloys", Staley, Amer.Soc. for Testing & Materials, Montreal CA, 1975, ASTM, Pub. 605, pp. 71-103.
On the Fabrication Aspect of Commercial . . . 5083 Aluminum Alloy Sheets, Yang et al, TMS 1995, Annual Meeting Feb. 1995, Las Vegas, USA, pp. 17-24.
Ltr. of Aug. 30, 1995—The Aluminum Association, Wash., DC, re signatories of the Decla. of Accord DA of the regist. of Alloy AA5385.
Advances in Hot Deformations Textures and Microstructures "Effect of Precipitate Structure on Hot Deformation of Al-Mg-Mn Alloys", Vetrano et al, Metals & Materials Society, 1994, pp 223-235.
"Development of Superplasticity in 5083 aluminum with Additions of Mn and Zr", Lavender et al, Material Science Forum, vols. 170-172, pp 279-286.
"Effect of Grain size and Dendirts . . . in al-Mg-Mn Alloys", Fukui et al, Journal of Light Metal Welding Construction, vol. 5, 1972, pp. 103,210.

(Continued)

*Primary Examiner*—John P. Sheehan
(74) *Attorney, Agent, or Firm*—Dennison, Schultz, Dougherty & MacDonald

(57) ABSTRACT

Rolled or extruded products for welded constructions made of AlMgMn type aluminum alloy. These products contain, in % by weight, 3.0<Mg<5.0, 0.75<Mn<1.0, Fe<0.25, Si<0.25, 0.02<Zn<0.40, optionally one or more of the elements Cr, Cu, Ti, Zr such that Cr<0.25, Cu<0.20, Ti<0.20, Zr<0.20, other elements <0.05 each and <0.15 in total, wherein Mn+2Zn>0.75. In the welded state, these products have improved mechanical strength and resistance to fatigue without unfavorable consequences with regard to toughness and corrosion resistance, and are particularly suitable for naval construction, for industrial vehicles and for bicycle frames made of welded tubes.

28 Claims, No Drawings

OTHER PUBLICATIONS

"Versagen Durch Scherbander . . . Aluminumwerkstoffen", Akeret, Z. Matallkde 92, 1991, pp. 249-258.
"Aluminium Properties and Physical Metallurgy", (Text Book), edited by Hatch, American Society for Metals, 1984.
"Superplastic Behavior of Al-Mg-Cu Alloys", Watanabe et al, Transactions ISIJ, vol. 27, 1987, pp. 730-733.
"Theory Assisted Design . . . Alloy Aluminum", Hornbogan et al, Acta Metall. Meter, vol. 41, No. 1, 1993, pp. 1-16.
"Effect of Filler Wire . . . of Thick Al-Mg Alloy 5083-0 Welds", Sakaguchi, 11W Doc. No. 1X-962-76, Intl. Institute of Welding, Apr. 1996, pp. 1-27.
"Fracture Characteristics of Thick Aluminum Alloy 5083/5183 Welds", Kuriyama, Doc. 1X-882-74, Intl. Institute of Welding, 1974, pp. 1-21.
"Light Alloys Metallurgy of the Light Metals" Polmear, 2nd Edit. 1989.
Yang et al, "On the Fabrication Aspect of Commercial Superplastic 5083 Aluminum Alloy Sheets", Superplasticity and Superplastic Forming, ed. Gosh et al, The Minerals, Metals & Materials Society 1995, pp. 17-24, 1995.
H.S. Campbell, "Superior Stress Corrosion Resistance of Wrought Aluminium-Magnesium alloys Containing 1% Zinc," Metallurgy of Light Alloys, vol. 20, pp 82-100, 1983.
"Data Sheets on Fatigue Properties for Butt Welded Joints of A5083P-O (A;-4.5Mg-0.6Mn) Aluminium alloy Plates," NRIM Fatigue Data Sheet No. 64, National Research Institute for Metals, Tokyo, JP, 1990.
Raynaud et al, "Aluminium Alloys for the Marine Market," Aluminio Log, vol. 8, No. 79, 1996, pp. 73-77.

* cited by examiner

PRODUCT FOR A WELDED CONSTRUCTION MADE OF ALMGMN ALLOY HAVING IMPROVED MECHANICAL STRENGTH

This application is a continuation of U.S. application Ser. No. 10/189,176, filed Jul. 5, 2002, now abandoned, which is a continuation-in-part of U.S. application Ser. No. 08/875,113, field Jul. 25, 1997, now U.S. Pat. No. 6,444,059, which was filed under 35 USC 371 on the basis of PCT/FR96/00279, field Feb. 21, 1996.

BACKGROUND OF THE INVENTION

1. Field of the Invention

The invention relates to the sphere of rolled or extruded products such as sheets, profiles, wires or tubes made of AlMgMn-type aluminum alloy containing more than 3% by weight of Mg, intended for welded constructions having a high yield stress, good resistance to fatigue and good toughness for structural applications such as ships, industrial vehicles or welded bicycle frames.

2. Description of Related Art

The optimum dimensioning of welded structures made of aluminum alloy leads to the use of 5000 series AlMg alloys according to the Aluminum Association nomenclature, in the cold-worked temper (temper H1 according to the standard NF-EN-515) or partially softened temper (temper H2), or stabilized temper (temper H3), while maintaining high resistance to corrosion (temper H116) rather than the annealed temper (temper 0). However, the improvement in the mechanical characteristics relative to the temper 0 does not usually remain after welding, and certifying and monitoring organizations generally recommend that only the characteristics in temper 0 be taken into consideration for welded structures. The resistance to fatigue and the fissure propagation rate should also be taken into consideration for dimensioning.

In this sphere, research has concentrated mainly on the implementation of the welding operation itself. There have also been attempts to improve the corrosion resistance of the article by appropriate thermomechanical treatments.

Japanese patent application JP 06-212373 proposes the use of an alloy containing 1.0 to 2.0% of Mn, 3.0 to 6.0% of Mg and less than 0.15% of iron to minimize the reduction in the mechanical strength due to welding. However, the use of an alloy having such a high manganese content leads to a reduction in the resistance to fatigue and in the toughness.

SUMMARY OF THE INVENTION

The object of the invention is significantly to improve the mechanical strength and fatigue resistance of welded structures made of AlMgMn alloy, under predetermined welding conditions, without unfavorable consequences for other parameters such as toughness, corrosion resistance and cutting deformation, due to internal stresses.

The invention relates to products for welded constructions made of an AlMgMn aluminum alloy containing, in % by weight:

$3.0<Mg<5.0$ $0.5<Mn<1.0$ $0.02<Zn<0.40$ $Fe<0.25$ $Si<0.25$ optionally one or more of the elements Cr, Cu, Ti, Zr such that:

$Cr<0.25$ $Cu<0.20$ $Ti<0.20$ $Zr<0.20$ other elements <0.05 each and <0.15 in total, wherein $Mn+2Zn>0.75$.

DETAILED DESCRIPTION OF THE INVENTION

Contrary to earlier research which concentrated on the welding process and the thermomechanical treatments, the inventors have found a particular, range of composition for minor alloying elements, in particular iron, manganese and zinc, leading to an interesting set of properties combining static mechanical characteristics, toughness, resistance to fatigue, resistance to corrosion and cutting deformation, this set of properties being particularly well adapted to the use of these alloys for naval construction, utility vehicles or the welded frames of bicycles.

This set of properties is obtained by combining a low iron content, <0.25%, preferably <0.20%, and even 0.15%, and a manganese and zinc content such that $Mn+2Zn>0.75\%$, preferably >0.8%. The Mn content should be >0.5%, preferably >0.8%, to have adequate mechanical characteristics, but should not exceed 1% if a deterioration in toughness and fatigue resistance are to be avoided. The addition of zinc combined with manganese has been found to have a beneficial effect on the mechanical characteristics of welded sheets and joints. However, it is better not to exceed 0.4% because problems can then be encountered in welding.

The magnesium is preferably kept >4.3%, because it has a favorable effect on the yield stress and fatigue resistance, but beyond 5% the corrosion resistance is less good. The addition of Cu and Cr are also favorable to the yield stress, but Cr is preferably kept <0.15% to maintain good resistance to fatigue.

The mechanical strength of the sheets depends both on the magnesium content in solid solution and on the manganese dispersoids. It has been found that the volumetric fraction of these dispersoids, which is linked to the iron and manganese contents, should preferably be kept above 1.2%. This volumetric fraction is calculated from the average of the surface fractions measured on polished cuts produced in three directions (length, width and thickness) by scanning electron microscopy and image analysis.

The products according to the invention can be rolled or extruded products such as hot- or cold-rolled sheets, wires, profiles or extruded and optionally drawn tubes.

The sheets according to the invention, which are assembled by butt welding by a MIG or TIG process and with a bevel of the order of 45° over about ⅔ of the thickness have, in the welded region, a yield stress $R_{0.2}$ which can be at least 25 MPa higher than that of a conventional alloy having the same magnesium content, that is a gain of about 20%.

The width of the thermally affected region is reduced by about one third relative to a conventional 5083 alloy, and the hardness of the welded joint increases from about 75 Hv to more than 80 Hv. The welded joints also have a tensile strength exceeding the minimum imposed by organizations monitoring unwelded cold-worked crude sheets.

The sheets according to the invention have fatigue resistance, measured by plane bending with a stress ratio wherein R=0.1 on samples taken in the cross-longitudinal direction, higher than:

$10^5$ cycles with a maximum stress >280 MPa;

$10^6$ cycles with a maximum stress >220 MPa;

$10^7$ cycles with a maximum stress >200 MPa.

The fissure propagation rate ΔK, measured when R=0.1, is >22 $Mpa\sqrt{m}$ when $da/dN=5\times10^{-4}$ mm/cycle and >26 $Mpa\sqrt{m}$ when $da/dN=10^{-3}$ mm/cycle.

The sheets according to the invention usually have a thickness greater than 1.5 mm. With thicknesses greater than 2.5 mm they can be obtained directly by hot rolling, without the need for subsequent cold rolling and, furthermore, these hot-rolled sheets are less distorted on cutting than cold-rolled sheets.

The products according to the invention have corrosion resistance which is as good as that of normal alloys having the same magnesium content, for example 5083 of common composition, widely used in naval construction.

EXAMPLE

Eight samples of sheets were prepared by conventional semi-continuous casting in the form of plates, were heated for 20 h at a temperature >500° C. and were then cold-rolled to the final thickness of 6 mm. The reference 0 corresponds to a conventional 5083 composition and reference 1 to a composition slightly outside the invention. The others have a composition according to the invention.

The compositions were as follows (% by weight):

| Ref. | Mg | Cu | Mn | Fe | Cr | Zn | Ti | Zr |
|---|---|---|---|---|---|---|---|---|
| 0 | 4.40 | <.01 | 0.50 | 0.27 | 0.09 | 0.01 | 0.01 | |
| 1 | 4.68 | <0.01 | 0.72 | 0.12 | 0.05 | <0.01 | 0.01 | |
| 2 | 4.60 | <0.01 | 0.85 | 0.17 | 0.10 | 0.16 | 0.01 | |
| 3 | 4.62 | <0.01 | 0.96 | 0.10 | 0.05 | 0.02 | 0.01 | |
| 4 | 4.80 | 0.09 | 0.80 | 0.11 | 0.03 | 0.02 | 0.01 | |
| 5 | 4.72 | <0.01 | 0.87 | 0.13 | 0.03 | 0.02 | 0.01 | 0.11 |
| 6 | 4.92 | 0.06 | 0.94 | 0.08 | 0.02 | 0.19 | 0.01 | |
| 7 | 4.69 | <0.01 | 0.72 | 0.07 | 0.02 | 0.10 | 0.01 | |

The samples all have, after rolling, a yield stress $R_{0.2}$ >220 Mpa in the L direction.

The mechanical strength of the joints welded from these sheets was measured under the following conditions: continuous automatic MIG butt welding with a symmetrical bevel having an inclination of 45° to the vertical over a thickness of 4 mm and filler wire of 5183 alloy.

The mechanical characteristics (tensile strength $R_m$, yield stress $R_{0.2}$) were obtained by pulling over samples standardized by the Norwegian monitoring organization DNV for naval construction having a length of 140 mm and a width of 35 mm, the weld bead with a width of 15 mm being in the center and the length of the narrow portion of the sample being 27 mm, that is the sum of the width of the bead and twice the thickness (15+22 mm).

The volumetric fractions of manganese dispersoids was also measured.

The results are as follows (in MPa for resistances and % for fractions):

| Ref. | $R_m$ | $R_{0.2}$ | Fractions |
|---|---|---|---|
| 0 | 285 | 131 | 0.62 |
| 1 | 292 | 144 | 1.2 |
| 2 | 300 | 146 | 1.6 |
| 3 | 310 | 158 | 1.7 |
| 4 | 309 | 149 | 1.4 |
| 5 | 305 | 155 | 1.5 |
| 6 | 318 | 164 | 1.9 |
| 7 | 310 | 153 | 1.5 |

It is found that the yield stress of samples welded according to the invention increases by between 15 and 35 MPa relative to the reference sample.

The resistance to fatigue of unwelded sheets subjected to plane bending wherein R=0.1 was also measured for references 0 to 4, while determining the maximum stress (in MPa) corresponding to $10^6$ and $10^7$ cycles respectively, as well as the fissure propagation rate ΔK measured when $da/dn=5\times10^{-4}$ mm/cycle (in $Mpa\sqrt{m}$).

The results were as follows:

| Ref. | $10^6$ cycles | $10^7$ cycles | ΔK |
|---|---|---|---|
| 0 | 220 | 200 | 22 |
| 1 | 235 | 205 | 22 |
| 2 | 225 | 200 | 23 |
| 3 | 230 | 205 | 22 |
| 4 | 225 | 200 | 22 |

It is found that, despite the increase in the mechanical strength, the sheets according to the invention have resistance to fatigue which is at least as good as that of conventional 5083 sheets.

What is claimed is:

1. Aluminum alloy sheet for a welded construction, consisting essentially of, in % by weight:

4.6<Mg<5.0

0.5<Mn<1.0

0.02≦Zn≦0.40

Fe<0.20

Si<0.25

Cr<0.25

Cu<0.20

Ti<0.20

Zr<0.20 other elements <0.05 each and <0.15 total, remainder Al, wherein Mn+2Zn>0.75.

2. Sheet according to claim 1, wherein Mn+2Zn>0.8.

3. Sheet according to claim 1, wherein Cr<0.10.

4. Sheet according to claim 1, wherein 0.10 Zn<0.40.

5. Sheet according to claim 1, wherein Mn>0.8.

6. Sheet according to claim 1, wherein Fe<0.15.

7. Sheet according to claim 1, wherein dispersoids are present in a volumetric fraction greater than 1.2%.

8. Sheet according to claim 1, having a thickness >2.5 mm and obtained directly by hot rolling.

9. Sheet according to claim 1, having, in an unwelded state, fatigue resistance, measured by plane bending wherein R=0.1 in the cross-longitudinal direction, higher than:

$10^5$ cycles, with a maximum stress >280 MPa;

$10^6$ cycles with a maximum stress >220 MPa;

$10^7$ cycles with a maximum stress >200 MPa.

10. Sheet according to claim 1, having a fissure propagation rate ΔK, measured when R=0.1, higher than:

22 $Mpa\sqrt{m}$ when da/dn=$5\times10^{-4}$ mm/cycle;

26 $Mpa\sqrt{m}$ when da/dn=$10^{-3}$ mm/cycle.

11. Sheet according to claim 1, welded by fusion to form a welded zone, and having a hardness >80 Hv in the welded zone.

12. Sheet according to claim 1, having a yield stress, measured on a standard DNV sample across an MIG butt welded joint, greater than 146 MPa.

13. Sheet according to claim 12, having a yield stress, measured on a standard DNV sample across an MIG butt welded joint, greater than 153 MPa.

14. Sheet according to claim 1, having after rolling, a yield stress $R_{0.2}$>220 Mpa in the L direction.

15. Sheet according to claim 7, wherein dispersoids are present in a volumetric fraction of 1.4 to 1.9%.

16. Aluminum alloy sheet for a welded construction, consisting essentially of, in % by weight:

4.6<Mg<5.0
0.5<Mn<1.0
0.02<Zn<0.40
Fe<0.25
Si<0.25
Cr<0.25
Cu<0.20
Ti<0.20
Zr<0.20
other elements <0.05 each and <0.15 total,
remainder Al,
wherein Mn+2Zn>0.80.

17. Sheet according to claim 16, wherein Cr<0.15.

18. Sheet according to claim 16, wherein 0.10≦Zn<0.40.

19. Sheet according to claim 16, wherein Mn>0.8.

20. Sheet according to claim 16, wherein dispersoids are present in a volumetric fraction greater than 1.2%.

21. Sheet according to claim 16, having a thickness >2.5 mm and obtained directly by hot rolling.

22. Sheet according to claim 16, having, in an unwelded state, fatigue resistance, measured by plane bending wherein R=0.1 in the cross-longitudinal direction, higher than:

$10^5$ cycles, with a maximum stress >280 MPa;

$10^6$ cycles with a maximum stress >220 MPa;

$10^7$ cycles with a maximum stress >200 MPa.

23. Sheet according to claim 16, having a fissure propagation rate ΔK, measured when R=0.1, higher than:

22 $Mpa\sqrt{m}$ when da/dn=5=$10^{-4}$ mm/cycle;

26 $Mpa\sqrt{m}$ when da/dn=$10^{-3}$ mm/cycle.

24. Sheet according to claim 16, welded by fusion to form a welded zone, and having a hardness >80 Hv in the welded zone.

25. Sheet according to claim 16, having a yield stress, measured on a standard DNV sample across an MIG butt welded joint, greater than 146 MPa.

26. Sheet according to claim 25, having a yield stress, measured on a standard DNV sample across an MIG butt welded joint, greater than 153 MPa.

27. Sheet according to claim 16, having after rolling, a yield stress $R_{0.2}$>220 Mpa in the L direction.

28. Sheet according to claim 20, wherein dispersoids are present in a volumetric fraction of 1.4 to 1.9%.

* * * * *